US005224280A

United States Patent [19]

Preman et al.

[11] Patent Number: 5,224,280

[45] Date of Patent: Jul. 6, 1993

[54] SUPPORT STRUCTURE FOR FOOTWEAR AND FOOTWEAR INCORPORATING SAME

[75] Inventors: Ron Preman, St. Louis, Mo.; Woo E. Ha, Pusan, Rep. of Korea; Min B. Kwan, Pusan, Rep. of Korea; Lee J. Myung, Pusan, Rep. of Korea

[73] Assignee: Pagoda Trading Company, Inc., St. Louis, Mo.

[21] Appl. No.: 751,085

[22] Filed: Aug. 28, 1991

[51] Int. Cl.[5] ..... A43B 13/12; A43B 21/32

[52] U.S. Cl. ..... 36/30 R; 36/27; 36/107

[58] Field of Search ..... 36/30 R, 27, 28, 37, 36/38, 107, 108, 76 R, 7.8, 151, 168, 179, 114

[56] References Cited

U.S. PATENT DOCUMENTS

| | | | |
|---|---|---|---|
| 2,532,742 | 12/1950 | Stoiner . | |
| 2,548,308 | 4/1951 | Hensley | 36/38 |
| 4,043,058 | 8/1977 | Hollister et al. . | |
| 4,128,950 | 12/1978 | Bowerman et al. . | |
| 4,316,332 | 2/1982 | Giese et al. . | |
| 4,316,335 | 2/1982 | Giese et al. . | |
| 4,340,626 | 7/1982 | Rudy . | |
| 4,342,158 | 8/1982 | McMahon et al. . | |
| 4,354,318 | 10/1982 | Frederick et al. . | |
| 4,364,188 | 12/1982 | Turner et al. . | |
| 4,391,048 | 7/1983 | Lutz . | |
| 4,439,937 | 4/1984 | Daswick | 36/108 |
| 4,486,964 | 12/1984 | Rudy . | |
| 4,490,928 | 1/1985 | Kawashima | 36/30 R |
| 4,506,460 | 6/1985 | Rudy . | |
| 4,551,930 | 11/1985 | Graham et al. . | |
| 4,561,140 | 12/1985 | Graham et al. . | |
| 4,561,195 | 12/1985 | Onoda et al. . | |
| 4,598,487 | 7/1986 | Misevich | 36/28 |
| 4,614,046 | 9/1986 | Dassler . | |
| 4,654,983 | 4/1987 | Graham et al. . | |
| 4,709,489 | 12/1987 | Welter . | |
| 4,733,483 | 6/1988 | Lin . | |
| 4,774,774 | 10/1988 | Allen, Jr. . | |
| 4,815,221 | 3/1989 | Diaz . | |
| 4,817,304 | 4/1989 | Parker et al. . | |
| 4,843,737 | 7/1989 | Vorderer . | |
| 4,843,741 | 7/1989 | Yung-Mao . | |
| 4,845,863 | 7/1989 | Yung-Mao . | |
| 4,854,057 | 8/1989 | Misevich et al. . | |
| 4,881,328 | 11/1989 | Yung-Mao . | |
| 4,890,397 | 1/1990 | Harada et al. . | |
| 4,897,936 | 2/1990 | Fuerst . | |
| 4,905,382 | 3/1990 | Lin . | |
| 4,908,962 | 3/1990 | Yung-Mao . | |
| 4,930,232 | 6/1990 | Engle . | |
| 4,974,345 | 12/1990 | Yung-Mao . | |
| 5,005,299 | 4/1991 | Whatley | 36/28 |
| 5,025,573 | 6/1991 | Giese et al. | 36/28 |
| 5,046,267 | 9/1991 | Kilgore et al. | 36/30 R |

*Primary Examiner*—Steven N. Meyers
*Attorney, Agent, or Firm*—Sandler, Greenblum & Bernstein

[57] ABSTRACT

A resilient member adapted for use within a sole of an article of footwear is disclosed, which member includes a transverse central section which is adapted to extend lengthwise across a sole of an article of footwear, and at least two substantially vertical portions. At least one of the substantially vertical portions is positioned adjacent each end of the central section. The substantially vertical sections are adapted to provide support and to be positioned adjacent to the lateral edges of a sole of an article of footwear. Optionally, a support member or members may be employed to support the resilient member. Windows in the lateral edges of the sole allow the resilient member to be viewed, even when supported, because the support member is a transparent cradle.

27 Claims, 4 Drawing Sheets

SUPPORT STRUCTURE FOR FOOTWEAR AND FOOTWEAR INCORPORATING SAME

BACKGROUND OF THE INVENTION

1. Field of the Invention

The present invention relates generally to footwear and more specifically to footwear having a sole which includes an insert that is capable of storing impact energy and returning it to the wearer for increased efficiency.

2. Description of Background Information

A considerable amount of research and development has been carried out in recent years to improve the soles of shoes, especially athletic shoes designed for running and/or jumping. Good impact absorption is an essential property for the soles of running and walking shoes, as well as for shoes used in sports which require jumping, e.g., basketball and aerobics. Not only must a sole absorb shock, but it must be durable to withstand repeated cycles of compression and expansion and it must do so resiliently. The sole must be dense and rigid enough to prevent the wearer's foot from bottoming out upon impact.

Lateral stability of the sole is also important in helping to prevent injuries to the wearer, and therefore the sole must be designed to accommodate vertical movements of compression while resisting lateral and horizontal shear movements. Recently, it has been discovered that a runner or jumper can improve performance by use of an athletic shoe which is more efficient in returning energy to the wearer during the expansion phase of the sole. In this respect, an efficient sole should be capable of storing some of the absorbed impact energy and returning it in a spring-like fashion to assist in propelling the wearer.

Many different approaches have been taken in designing a sole which achieves the above requirements. One type of sole structure which has been designed specifically to attempt to give an appropriate impact response is a sole which contains fluid, either in the form of a liquid or a gas. However, unreliability is often a problem with these types of soles as they may develop leaks.

Another type of sole, which is, e.g., disclosed in U.S. Pat. No. 4,364,188, provides a sole made of a first resilient material having a given durometer hardness for absorbing shock. Plugs having a higher durometer hardness are inserted into the sole to provide an increased resistance to compression.

U.S. Pat. No. 4,342,158 discloses a biomechanically tuned shoe which incorporates a large, bellows-shaped main spring in the heel of the sole of the shoe. The main spring exhibits a large vertical compliance which can impart an unnatural feel to the runner's stride, and disrupt the natural rhythm of the runner's gait.

U.S. Pat. No. 4,815,221 discloses a sole member having a cavity for receiving a spring system which includes a spring plate, a plurality of resilient and compressible projections, and a stiffening member against which the projections exhibit resilient force.

Yet another type of sole is disclosed in U.S. Pat. No. 4,128,950, which discloses a multi-layered sole formed of a closed cell foam, having a semirigid, flat stabilizer plate positioned therein.

Thus, it is desirable to provide a sole with a resilient member which will efficiently store energy and return it to a wearer.

SUMMARY OF THE INVENTION

One advantage of the present invention is achieved by providing a sole with a resilient member which is capable of storing large amounts of energy with only a relatively small vertical displacement. The resilient member aids the sole in returning energy to the wearer with a high degree of efficiency.

A further advantage obtained by the present invention is that the resilient member employed transiently stores energy upon impact and during compression of the sole, and returns energy during the expansion phase of the sole when the sole is no longer loaded.

Yet another advantage is achieved by a relatively simple, support structure which is lightweight and easy to manufacture.

Accordingly, it is one object of the present invention to provide a lightweight sole which is capable of efficiently absorbing shock upon impact, and which is further capable of storing impact energy and returning energy to the foot of the wearer during the expansion phase of the sole.

It is another object of the present invention to provide additional support members for providing both additional vertical and lateral support to the sole, thus enabling soles to be designed to accommodate wearers of different weights and gaits.

Still another object is to both achieve desired resiliency and support for a wearer, and also to provide indicia on the support structure which is visible from the exterior of the shoe.

Yet another object of the present invention is to provide a resilient member for supporting a foot, and to provide structure for reliably and securely, yet yieldably, connecting the resilient member to a shoe sole.

Other objects and advantages of the present invention, and advantageous features thereof, will become apparent in the description which follows herein.

Included in the description is a resilient member adapted to be positioned within a sole of an article of footwear first and second lateral edges. The resilient member includes a central section having opposed first and second ends which are adapted to extend transversely across the width dimension of a sole of an article of footwear, and at least two substantially vertical sections connected to the opposed ends of the central section. The substantially vertical sections are adapted to be positioned adjacent to the lateral edges of the sole of an article of footwear.

Channels may connect the substantially vertical portions of the resilient member to the central section. Each channel includes a substantially vertical channel portion and a substantially horizontal channel portion. Each of the substantially vertical channel portions is connected to the transverse portion and each substantially horizontal channel portion is connected to a respective vertical channel portion and to one of the substantially vertical sections.

Optionally, each of the substantially vertical channel portions may include at least one reinforcing corrugation. Further, the central section may include at least one slot extending therethrough.

The resilient member is also described in combination with a sole for an article of footwear. The sole includes resilient foam and also has front and rear edges. The resilient member is substantially embedded within the foam of the sole. The sole is further defined as having a heel area, an arch area and a forefoot area, and the resilient member extends across the width of the heel area of the sole. The foam of the sole surrounds at least a substantial portion of the resilient member.

The substantially vertical section of the resilient member has an outer surface, which is visible exteriorly of the sole, via windows in the sole. The central section of the resilient member is described as being generally arcuate, and bowed generally upwardly.

The resilient member is preferably formed of a polyester elastomer, and the foam is preferably a closed-cell polyurethane foam, having a density not substantially less than 15 pounds per cubic foot and not substantially greater than 16 pounds per cubic foot. Another embodiment uses closed-cell polyurethane foam having a density of about 17 pounds per cubic foot.

The combination of sole and resilient member is further described in combination with an upper connected to the sole to form an article of footwear.

The resilient member may further include a support member which is adapted to be positioned under and adjacent to the resilient member, and within the sole. The support member includes at least two generally U-shaped support channels which are positioned under and adjacent to the resilient member channels exteriorly of the resilient member channels. The support member is further disclosed as being transparent, and is preferably made of polyvinyl chloride.

The support channels are spaced apart from each other with respect to the width of said sole, and may be connected by a generally arcuate central support section which is adapted to underlie the central section of the resilient member. Alternatively, the support channels may be separately formed members which are unattached to each other.

Also included in the description is a sole for an article of footwear which includes the resilient member and the support member extending transversely across the sole.

The outer surfaces of each substantially vertical section described may optionally have a predetermined design therein. The sole includes windows through which the predetermined design is visible. This embodiment is also further disclosed in combination with an upper connected to the sole to form an article of footwear.

The sole includes foam which substantially surrounds the resilient member and the support member. The foam may form an upper layer on top of the resilient member and a lower layer located below the support member. The sole has at least one foam layer having front, rear and lateral edges, and having a predetermined length and width, a heel area, an arch area and a forefoot area. Two substantially vertical panels of the resilient member are positioned adjacent to respective lateral edges of the foam layer. The resilient member is embedded within, and extends lengthwise across the width of the at least one foam layer adjacent the heel area.

BRIEF DESCRIPTION OF THE DRAWINGS

The present invention is further explained in the description which follows, with reference to the drawings, illustrating, by way of non-limiting examples, various embodiments of the invention, with like reference numerals representing similar parts throughout the several views, and wherein.

DESCRIPTION OF THE PREFERRED EMBODIMENTS

Figure 1:
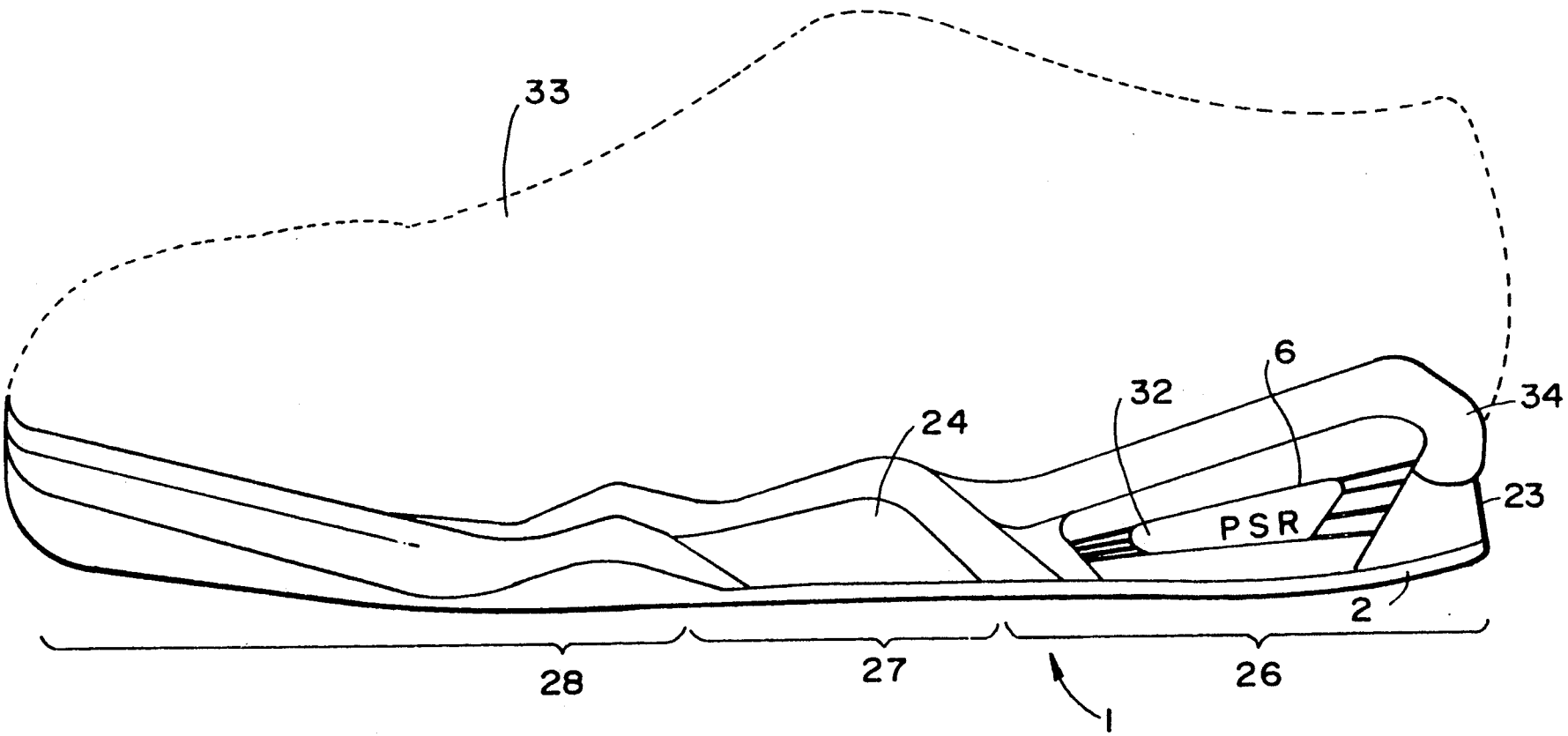
FIG. 1 is a side plan view of an article of footwear including an upper attached to a sole, with the upper shown in phantom.

Referring now to the drawings in detail, FIG. 1 shows a complete article of footwear. The footwear includes a sole 1 having heel area 26, arch area 27 and forefoot area 28, which are adapted to accommodate the heel, arch, and forefoot of a wearer, respectively. Attached to sole 1 is upper 33 (shown in phantom), which can be of any conventional design. Sole 1 is further defined by front portion or edge 25, rear portion or edge 23, and lateral areas or edges 24 (although only one side is shown in FIG. 1). Windows 6 are located in the lateral edges of the sole in the heel area and permit the resilient member of the present invention (and optional predetermined design 32) to be viewed from the exterior of the shoe. Outer sole layer 2 underlies the rest of the sole and is attached thereto, preferably by gluing or thermal bonding.

Figure 2:
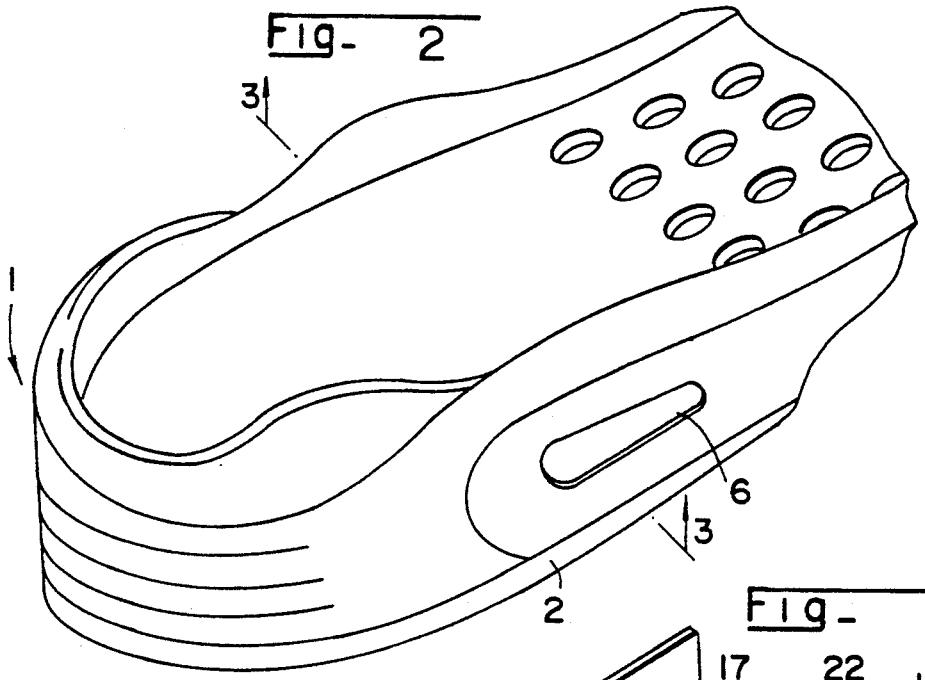
FIG. 2 is a perspective view of the heel region of a sole according to the invention.

FIG. 2 shows a partial view of sole 1, emphasizing the heel area which is pertinent to the invention herein. Windows 6 reveal the inner resilient member which, in this embodiment does not include any predetermined design or indicia thereon. Transversely located within the sole, between windows 6, is resilient member 3, which is more clearly shown in the cross-sectional view of FIG. 3, taken along the plane 3—3 of FIG. 2.

Sole 1 is composed essentially of one or more layers of foam 5. Foam 5 is preferably a closed-cell foam, e.g., closed-cell polyurethane foam, and extends essentially over the full length and width of the sole. Materials other than polyurethane foam may be used instead of polyurethane foam, as long as they are sufficiently hard to provide adequate shock absorption, while still being soft enough to provide the wearer with sufficient cushioning and comfort to prevent injury and allow maximum wearing enjoyment.

The density of the polyurethane foam used for the sole, according to the present invention, is not substantially less than 10 pounds per cubic feet nor substantially greater than 20 pounds per cubic feet. Preferred embodiments of the present invention include soles made of polyurethane foam having a density not substantially less than 15 pounds per cubic feet nor substantially greater than 16 pounds per cubic feet, with soles comprised of polyurethane foam having a density of about 17 pounds per cubic feet also being acceptable.

In order to provide the sole with greater resiliency and at the same time improve shock absorption characteristics of the sole, resilient member 3 is transversely positioned within foam 5 in the heel area of sole 1. In the illustrated embodiment, two layers of foam 5 are shown, although more than two layers, or one layer could also be used. In any case, however, it is preferred that the resilient member be embedded in the foam. Resilient member 3 is formed of a material and of a shape which enables it to store large amounts of energy with only a small vertical displacement. The vertical displacement occurs upon impact of the wearer's heel with the surface upon which the wearer is walking, running, jumping or performing some other sports activity.

Upon release of the impact force, resilient foam 5 expands substantially back to its unstressed position. Resilient member 3 is capable of returning substantially to its unstressed position much quicker and more efficiently than is foam 5. Consequently, resilient member 3 is able to return substantial amounts of energy to the wearer of the article of footwear during the unloaded phase of the wearer's motion, resulting in a springboard effect which increases the wearer's efficiency and performance.

The preferred material for resilient member 3 is HYTREL, which is a registered trademark owned by the DuPont Co., for a thermoplastic polyester elastomer. Specific properties of HYTREL are described in the DuPont publication entitled "HYTREL Product and Properties Guide," the entire disclosure of which is hereby incorporated by reference. However, any polymer or other material which is lightweight and which is capable of efficiently and transiently storing energy during the compression phase of a sole, and of returning energy efficiently during the expansion phase of the loading cycle of the sole, may be used. HYTREL is particularly desirable because of its excellent properties, i.e., it is tough, resilient, and absorbs shock very effectively. It has outstanding low temperature flexibility and high resistance to booth creep and flex-fatigue.

Figure 4:
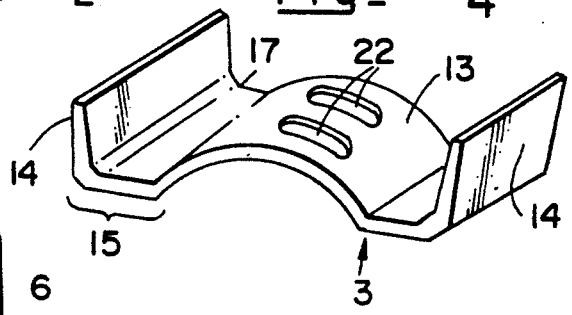
FIG. 4 is a plan view of the resilient member of the first embodiment, according to the invention.
Figure 3:
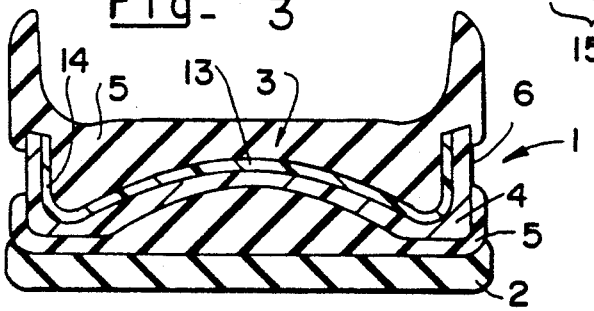
FIG. 3 is a transverse cross-sectional view of the sole showing one embodiment of a resilient member in place in the sole.
Figure 7:
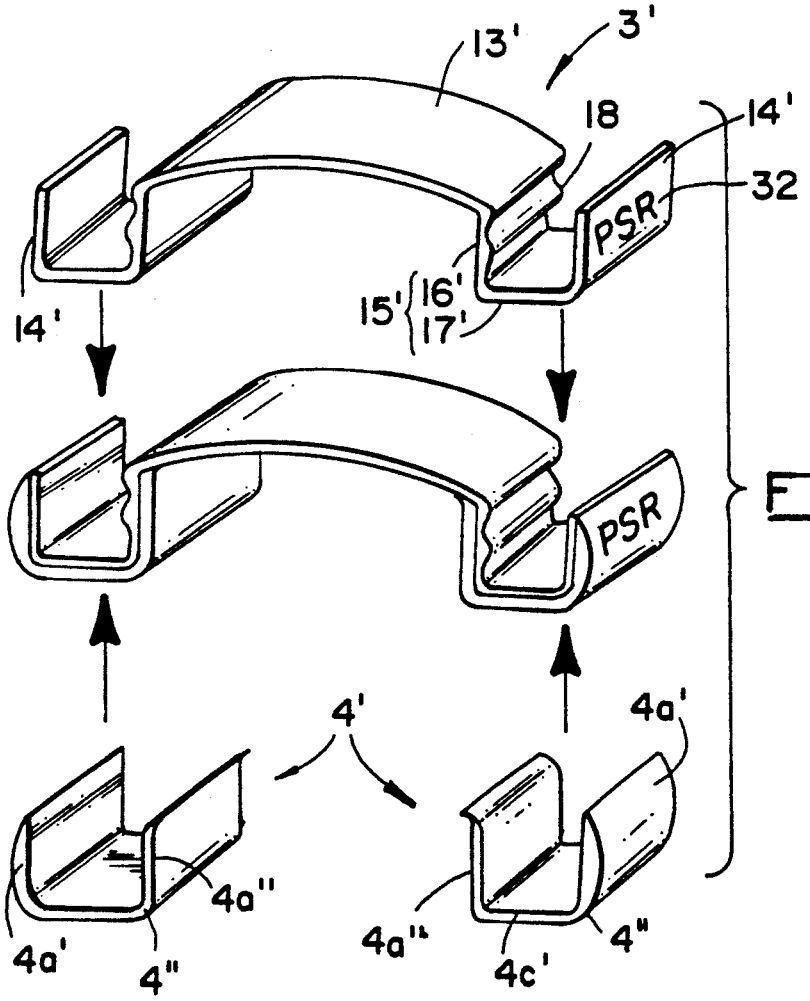
FIG. 7 is an exploded view of the resilient member and support means shown in FIG. 6.
Figure 8:
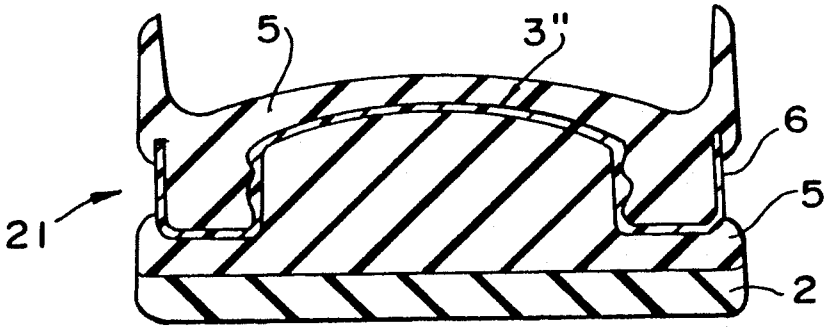
FIG. 8 is a cross-sectional view of an embodiment of a sole employing a resilient member with no additional support member.

As shown in FIG. 4, resilient member 3 includes a generally arcuate transverse portion 13, substantially vertical portions 14 and channel portions 15. Transverse portion 13 has length, width and thickness dimensions, and may be more or less arcuate as seen in the differences between the embodiments shown in FIGS. 4 and 7. Regardless of the amount of its curvature, however, transverse member 3 is designed such that its length dimension substantially traverses the width of footwear sole 1 in the heel area of the footwear. Substantially vertical portions 14 lie at or beyond the opposed ends of the transverse portion and are positioned to be substantially flush with the lateral edges of sole 1; although, as shown in FIG. 3, e.g., they are likely offset inwardly from these side edges of the sole, such as by windows 6, and the thickness of any intervening cradle or support 4. Lateral edges 24 of sole 1 include windows which are formed by cutaway portions of foam 5. Windows 6 allow substantially vertical portions 14 of resilient member 3 to be viewed from the exterior of the sole as is best shown in FIG. 8.

Transverse portion 13 may include one or more slots 22, extending transversely along the lengthwise direction of member 3 which decrease the weight of the resilient member and vary the bending characteristics of the member. The number, size, and position of the slots can be varied in order to vary the resiliency and support provided by this member. Channels 15 include substantially horizontal channel portions 17 which connect substantially vertical portions 14, with opposed ends of resilient member 13. Additional substantially vertical channel walls 16 can be provided to connect portions 17 to the ends of member 13, as shown in the embodiment of FIG. 7, e.g.

Figure 5:
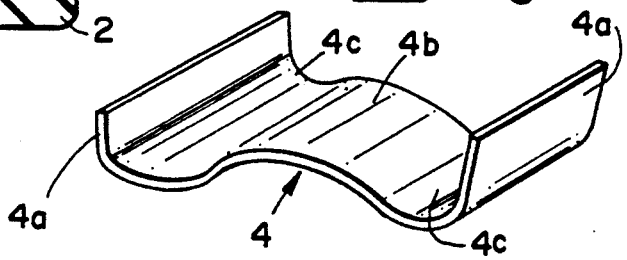
FIG. 5 is a plan view of a support for the resilient member of FIG. 4.

Optionally, an additional support member, or cradle, 4 may be positioned within the sole 1, as shown in FIGS. 3 and 5. This additional support 4 provides increased stiffness for more resistance to heavier loads and enables resilient member 3 to withstand loads incurred with heavier users, or where a more pounding type of use is expected for the article of footwear.

Cradle 4 has a central arcuate portion **4*b* which is adapted to be placed immediately underneath and adjacent to transverse portion 13, channels 4*c* under channels 15, and has substantially vertical outer walls 4*a* which are positioned immediately externally of and adjacent to, substantially vertical portions 14. Support 4 is preferably bonded to resilient member 3, either by adhesives or thermal bonding. Polyvinyl chloride is one preferred material for use as the additional support, but other materials may be used which exhibit the desired properties of lightweight flexibility and resiliency, yet exhibit a greater hardness than the material used for resilient member 3. Cradle 4 is also preferably transparent, to allow the exterior surface of substantially vertical portion 14 of resilient member 3 to be viewed through windows 6. In this fashion, any indicia and/or design placed on the exterior surfaces of panels or portions 14 can be seen via windows 6**.

Figure 6:
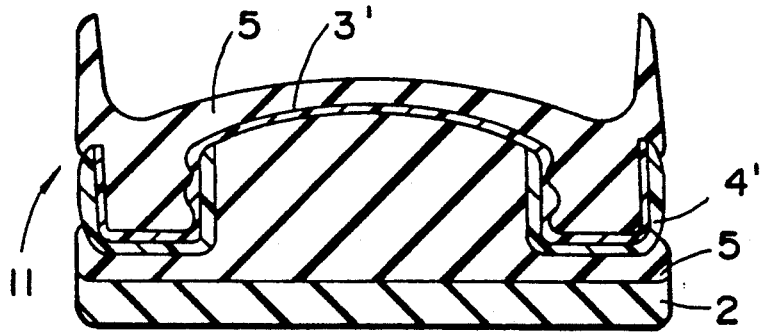
FIG. 6 is a cross-sectional view of a sole showing a second embodiment of a resilient member as well as a second embodiment of a support member.

A second embodiment of resilient member 3', additional support member 4' and the resultant combined sole 11 are depicted in FIG. 6. An exploded view of the resilient member 3' and additional support or cradles 4' are shown in FIG. 7. The external surfaces of the additional substantially vertical panels or walls 16' of resilient member 3' include one or more ridges or corrugations 18, which provide added rigidity to this portion of resilient member 3' and more markedly reinforce the torsional stability of the heel portion of the sole. The external surfaces of substantially vertical surfaces 14' may optionally include a predetermined design 32 therein, which is preferably molded into the component. Thus, both the texture of the walls or panels 14', and any indicia thereon, are visible through sole window 6.

In this embodiment, resilient member 3' includes a central, generally arcuate panel 13', channels 15' on opposed sides of panel 13', with each channel including generally parallel, generally vertical walls 16', 32, and base channel portions 17'.

The second embodiment of additional support member 4' includes two spaced apart channel support members 4'. Each support or cradle includes a base channel **4*c*', an outer wall 4*a*', and an inner wall 4*a*''. This support maintains all of the resiliency and vertical compliance of transverse section 13', while also reinforcing channel portions 15' and substantially vertical panels 16' and 14' of resilient member 3'. Channel support members 4'' are preferably made of transparent polyvinyl chloride which is tough, lightweight, inexpensive and resilient, and which allows resilient member 3' and predetermined design 32 to be viewed through windows 6**.

Channel support members 4'' lie immediately under and adjacent to substantially horizontal channel portions 17', immediately internal and adjacent to substantially vertical channel portions 16' and immediately external and adjacent to substantially vertical portions 14'. Channel support members 4'' are preferably bonded to resilient member 3' with adhesives or by thermal bonding to increase their supporting function.

FIG. 8 shows a third embodiment of a sole 21 according to the present invention, which includes the resilient member 3' as in the previous embodiment, but with no additional support member. In this embodiment, resilient member 3', shown in FIG. 4, is embedded in a sole of the type described above, without the use of additional support means. Such structure is obviously less expensive to manufacture than those noted above, but will no provide the same support. As in all of the embodiments, the sole includes one or more foam layers 5, preferably formed from a closed cell foam as noted above, and the resilient member can either be surrounded by a single foam layer, or positioned between two adjacent foam layers.

Although the invention has been described with reference to particular means, materials and embodiments, it is to be understood that the invention is not limited to the particulars disclosed, and extends to all equivalents within the scope of the claims appended hereto.

What is claimed is:

1. A resilient member adapted to be positioned within a sole of an article of footwear having first and second lateral edges, said resilient member comprising:

a central section having opposed first and second ends and being adapted to extend transversely across the width dimension of a sole of an article of footwear; and at least two substantially vertical sections connected to said opposed ends, said substantially vertical sections being adapted to be positioned adjacent to said lateral edges of a sole of an article of footwear;

channels which connect said substantially vertical portions to said central section, wherein each of said channels comprises a substantially vertical channel portion and a substantially horizontal channel portion, each of said substantially vertical channel portions being connected to said transverse portion and each said substantially horizontal channel portion being connected to a respective vertical channel portion and to one of said substantially vertical sections; and a support member including at least two generally U-shaped support channels which are positioned under and adjacent to said resilient member channels exteriorly of said resilient member channels.

2. The resilient member of claim 1, wherein each of said substantially vertical channel portions includes at least one reinforcing corrugation.

3. The resilient member of claim 1, wherein comprising at least one slot extending through said central section.

4. The resilient member of claim 1, said central section being generally arcuate.

5. The resilient member of claim 4, wherein said central section is bowed generally upwardly.

6. The resilient member of claim 1, said member comprising a polyester elastomer.

7. The resilient member of claim 1, wherein said support member is transparent.

8. The resilient member of claim 1, wherein said support member comprises polyvinyl chloride.

9. The resilient member of claim 1, said support channels being spaced apart from each other with respect to the width of the sole.

10. The resilient member of claim 9, said support channels comprising separately formed members which are unattached to each other.

11. The resilient member of claim 9, wherein said support channels are connected by a central support section, adapted to underlie the central section of said resilient member.

12. The resilient member of claim 11, wherein said central support section is generally arcuate.

13. The resilient member of claim 1, wherein each said substantially vertical section has an outer surface with a predetermined design therein.

14. A sole for an article of footwear comprising:

at least one foam layer comprising front, rear and lateral edges and having a predetermined length and width, a heel area, an arch area and a forefoot area;

a resilient member comprising a central section and two substantially vertical panels, said panels being positioned adjacent to respective lateral edges of said at least one foam layer, said resilient member being embedded within, and extending lengthwise across, said width of said at least one foam layer adjacent said heel area; and a support member positioned under and adjacent to said resilient member, wherein said resilient member includes at least two channels connecting said substantially vertical panels to said central section, said support member comprising two channel support members which are positioned under and adjacent to said channels.

15. The sole of claim 14, wherein said resilient member comprises a polyester elastomer and said foam comprises polyurethane foam.

16. The sole of claim 15, wherein said polyurethane has a density not substantially less than 15 pounds per cubic foot and not substantially greater than 16 pounds per cubic foot.

17. The sole of claim 15, wherein said polyurethane has a density of about 17 pounds per cubic foot.

18. The sole of claim 14, wherein each said substantially vertical panel has an outer surface with a predetermined design therein, wherein said at least one foam layer comprises windows, located along said lateral edges, through which said predetermined design is visible.

19. The sole of claim 14, said resilient member further comprising channels which connect said substantially vertical panels to said central section.

20. The sole of claim 14, wherein said at least one foam layer comprises polyurethane foam.

21. The sole of claim 14, wherein said resilient member comprises polyester elastomer.

22. The sole of claim 14, comprising two foam layers, a first layer positioned above said resilient member, and a second layer positioned below said resilient member.

23. The sole of claim 14, wherein said support member providing additional support comprises polyvinyl chloride.

24. The sole of claim 14, wherein said support member is transparent.

25. The sole of claim 14, said support member further comprising a central support panel underlying said central section.

26. The sole of claim 14, wherein said foam layer comprises a closed cell foam having a density of approximately 15–17 pounds per cubic foot.

27. An article of footwear, comprising, in combination:

a sole for an article of footwear comprising:

at least one foam layer comprising front, rear and lateral edges and having a predetermined length and width, a heel area, an arch area and a forefoot area;

a resilient member comprising a central section and two substantially vertical panels, said panels being positioned adjacent to respective lateral edges of said at least one foam layer, said resilient member being embedded within, and extending lengthwise across, said width of said at least one foam layer adjacent said heel area; and a support member positioned under and adjacent to said resilient member, wherein said resilient member includes at least two channels connecting said substantially vertical panels to said central section, said support member comprising two channel support members which are positioned under and adjacent to said channels; and an upper connected to said sole to form said article of footwear.

* * * * *